United States Patent [19]

Terada et al.

[11] 4,450,221

[45] May 22, 1984

[54] ENCAPSULATED LYOPHILIC MAGNETIC PARTICLE AND RESIN TONER

[75] Inventors: Sadatugu Terada; Satoshi Haneda, both of Hachioji; Makoto Tomono; Syunji Matsuo, both of Hino, all of Japan

[73] Assignee: Konishiroku Photo Industry Co., Ltd., Tokyo, Japan

[21] Appl. No.: 390,828

[22] Filed: Jun. 22, 1982

[30] Foreign Application Priority Data

Jul. 10, 1981 [JP] Japan ..... 56-108444

[51] Int. Cl.[3] ..... G03G 13/20; G03G 9/14

[52] U.S. Cl. ..... 430/106.6; 430/107; 430/138; 430/98; 430/124

[58] Field of Search ..... 430/106.6, 138, 107, 430/110

[56] References Cited

U.S. PATENT DOCUMENTS 4,016,099 4/1977 Wellman et al. ..... 430/138

4,254,201 3/1981 Sawai et al. ..... 430/106.6

*Primary Examiner*—John E. Kittle

*Assistant Examiner*—John L. Goodrow

*Attorney, Agent, or Firm*—Jordan B. Bierman; Linda Bierman

[57] ABSTRACT

A magnetic toner comprising nuclear particles comprising lyophilic magnetic particles and a resin having a low softening point is disclosed. Each of the nuclear particles is surrounded by a resin wall.

21 Claims, No Drawings

ENCAPSULATED LYOPHILIC MAGNETIC PARTICLE AND RESIN TONER

FIELD OF THE INVENTION

The present invention relates to a toner for developing an electrostatic latent image in electrophotography or electrostatic printing, more particularly, to a capsule toner adapted to pressure fixing of an electrostatic latent image.

BACKGROUND OF THE INVENTION

Many electrophotographic processes are known in the art, and some of them are described in U.S. Pat. No. 2,297,691, Japanese Patent Publication No. 23910/67 and Japanese Patent Publication No. 24748/68. The operating principle of electrophotography is as follows: an electrostatic latent image is formed on a photoreceptor by various means using photoconductivity, then the latent image is developed with a toner, and the toner image is optionally transferred to paper and other receiving sheets, and fixed by application of heat, pressure or solvent vapors to provide the desired copy. Various processes are also known to render the electrostatic latent image visible with a toner, for example, the magnetic brush method as described in U.S. Pat. No. 2,874,063, the cascade development method as described in U.S. Pat. No. 2,618,552, the powder cloud and fur brush method as described in U.S. Pat. No. 2,221,776, and the liquid development method. The toners conventionally used in these developing methods are made of fine particles of natural or synthetic resins having dyes or pigments dispersed therein. Fine toner particles that include a third component for a specific purpose are also known.

The resulting toner image is fixed after it is optionally transferred to paper or other receiving sheets. Various fixing methods are known, for example, fusing the toner particles with a heater or hot rollers so that they are fixed to a support, or softening or dissolving the binder resin with an organic solvent to thereby fix the toner particles onto the support, or by fixing the toner particles onto the support under pressure. The toner is made of a material so selected as to suit the specific fixing method, and the toner used in one fixing method is not usually applicable to another method. In particular, the toner used in the common heat-fusion fixing method that employs a heater is hardly applicable to the fixing with a heat roller, a solvent or under pressure. Therefore, the primary concern of researchers is to develop toners that suit specific fixing methods.

Methods of fixing toner particles under pressure are described in U.S. Pat. No. 3,269,626, Japanese Patent Publication No. 15876/71 and other patents. Fixing under pressure has various advantages: less energy is needed, no pollution hazared, copying can be started as soon as the copier is turned on, no scorching of the copy, high-speed fixing, and simple mechanism of the fixing apparatus. But the fixing under pressure has its own problems, i.e. poor fixability of the toner and the phenomenon of off-setting to the press rollers, and to solve these problems, many studies have been made. For example, Japanese Patent Publication No. 9880/69 describes a toner for pressure fixing that contains an aliphatic component and a thermoplastic resin. Japanese Patent Applications (OPI) Nos. 75032/73, 78931/73, 17739/74 and 108134/77 (the symbol OPI as used herein means an unexamined published Japanese patent application) describe capsule type toners for pressure fixing that comprise nuclear particles encapsulated with a soft material. Japanese Patent Application (OPI) No. 75033/73 describes a toner for pressure fixing that uses a block copolymer of tenacious polymer and a soft polymer.

The improvements achieved by these patents are so great that some toners for pressure fixing are being used on a commercial scale, but the one-component developer using a magnetic toner containing a magnetic powder still has many problems to solve. The binder resin used in the magnetic toner must meet the following requirements: the magnetic particles are uniformly dispersed in the resin and adhere to it strongly; the resin provides the toner with great impact resistance as well as good flowability. However, when the electrostatic latent image is developed with the one-component developer and by means of charging through friction with the developing sleeve rollers, the core material often separates from the shell material which builds up on the sleeve rollers by the process of triboelectrification, thus greatly shortening the service life of the toner. For these reasons, no commercial capsule toner suitable for use in one-component developers has been attained.

SUMMARY OF THE INVENTION

Therefore, the primary object of the present invention is to provide a magnetic toner for use in one-component developers that has good fixability under pressure, great impact resistance and a long service life. This object can be achieved by a magnetic toner wherein each of the nuclear particles made of lyophilic magnetic particles and a resin having a low softening point is surrounded by a resin wall. The magnetic toner of the present invention is prepared by first making magnetic particles lyophilic preferably with a titanate coupling agent or silane coupling agent, then dispersing the magnetic particles in a resin having a low softening point to make nuclear particles, and surrounding each nuclear particle with a resin wall having a higher softening point.

DETAILED DESCRIPTION OF THE INVENTION

The nuclear particles of the present invention are prepared by the pulverization method wherein the lyophilic magnetic particles are blended with the resin having a low softening point, the blend is milled under heating, the kneaded blend is frozen, pulverized, classified and the classified particles are preferably injected into a hot blast of air to form spherical particles. Spherical nuclear particles may be prepared by the polymerization method wherein a blend of a vinyl polymerizable monomer containing a dye or pigment and the lyophilic magnetic particles or a blend of said monomer, magnetic particles and a titanate or silane coupling agent is subjected to suspension polymerization in an aqueous dispersion medium in the presence of a dispersion stabilizer. If the particles so obtained are coarse, the desired nuclear particles may be produced by adding a dye or pigment, milling the blend in a molten stage, freezing the molten blend, pulverizing the blend, classifying the particles and optionally injecting the classified particles into a hot blast of air. Each of the resulting nuclear particles can be surrounded with a resin wall by any of the known encapsulating techniques, and a resin wall having a softening point of 100° C. or higher is preferably formed by crosslinking and other suitable means.

As described above, the nuclear particles for the resin toner of the present invention are prepared by either pulverizing a milled blend of magnetic particles and a resin or by subjecting to suspension polymerization a blend of magnetic particles and a polymerizable monomer. The resin used in the pulverization method is selected from among the following resins that are commonly empolyed in electrophotography: homopolymers of $\alpha,\beta$-unsaturated ethylenic monomer such as styrenes, e.g. styrene, p-chlorostyrene and methylstyrene; vinylnaphthalenes; vinyl halides, e.g. vinyl chloride, vinyl bromide, and vinyl fluoride; vinyl esters, e.g. ethylene-vinyl acetate, vinyl acetate, vinyl propionate, vinyl benzoate and vinyl butyrate; esters of $\alpha$-methylene aliphatic monocarboxylic acids, e.g. methyl acrylate, ethyl acrylate, n-butyl acrylate, isobutyl acrylate, dodecyl acrylate, n-octyl acrylate, 3-chloroethyl acrylate, phenyl acrylate, methyl $\alpha$-chloroacrylate, methyl methacrylate, ethyl methacrylate, and butyl methacrylate; vinyl ethers, e.g. acrylonitrile, acrylamide vinyl methyl ether, vinyl isobutyl ether and vinyl ethyl ether; vinyl ketones, e.g. vinyl methyl ketone, vinyl hexyl ketone and methyl isopropynyl ketone; and N-vinyl compounds, e.g. N-vinylpyrrole, N-vinylcarbazole, N-vinylindole and N-vinylpyrrolidone; copolymers of these monomers; and other polymers such as epoxy resins, rosin-modified phenol-formaldehyde resins, cellulose resins, polyether resins, polyvinyl butyral resins, styrenebutadien resins, polyester resins, polyamide resins, casein, carboxymethyl cellulose, starch, and polyvinyl alcohol. Resins having a softening point not higher than 100° C. are preferred, and those having a softening point of 80° C. or lower are particularly preferred.

The resins having softening points not exceeding 100° C., preferably not exceeding 80° C., may be prepared by blending resins having higher softening points with resins that are liquid at ambient temperatures, such as terpene resins, pinene resins and epoxy resins, or plasticizers such as tricresyl phosphate, trioctyl phosphate, triphenyl phosphate, octyldiphenyl phosphate, cresyldiphenyl phosphate, diethyl adipate, chlorinated paraffin, chlorinated aliphatic acid ester, dimethyl phthalate, diethyl phthalate, dibutyl phthalate, microcrystalline wax and Hoechst wax.

Examples of the polymerizable monomer for use in the suspension polymerization method include styrene and styrene derivatives such as o-methylstyrene, m-methylstyrene, p-methylstyrene, p-ethylstyrene, 2,4-dimethylstyrene, p-n-butylstyrene, p-tert-burylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene and 3,4-dichlorostyrene.

Other vinyl monomers include ethylenically unsaturated monolefins such as etylene, propylene, butylene and isobutylene; vinyl halides such as vinyl chloride, vinylidene chloride, vinyl bromide and vinyl fluoride; vinyl esters such as vinyl acetate, vinyl propionate, vinyl benzoate and vinyl butyrate; esters of $\alpha$-methylene aliphatic monocarboxylic acids such as methyl acrylate, ethyl acrylate, n-butyl acrylate, isobutyl acrylate, propyl acrylate, n-octyl acrylate, dodecylacrylate, 2-ethylhexyl acrylate, stearyl acrylate, 2-chloroethyl acrylate, phenyl acrylate, methyl $\alpha$-chloroacrylate, methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic acid or methacrylic acid derivatives such as acrylonitrile, methacrylonitrile and acrylamide; vinyl ethers such as vinyl methyl ether, vinyl ethyl ether and vinyl isobutyl ether; vinyl ketones such as vinyl methyl ketone, vinyl hexyl ketone and methyl isopropenyl ketone; N-vinyl compounds such as N-vinylpyrrole, N-vinylcarbazole, N-vinylindole and N-vinylpyrrolidone; and vinylnaphthalenes. These monomer may be used alone to form homopolymers or two or more of such monomers may be used to form copolymers.

When the nuclear particles are prepared by suspension polymerication, a molecular weight modifier may be added to prevent excessive polymerization. Alternatively, an inert liquid resin or one of the plasticizers listed above may be added to the polymerizable monomers before suspension polymerization.

As the magnetic particles such materials as to be strongly magnetized by the magnetic field in the direction thereof and, preferably, those having black color, chemically stable and with the particle diameter of less than 1$\mu$ will preferably be used. From such viewpoint, most preferred material is magnetite (triiron tetroxide). Typical magnectic or magnetizable materials include such matals as cobalt, iron, nickel, and the like; alloy and mixtures of such metals as aluminum, cobalt, copper, iron, magnesium, nickel, tin, zinc, antimonium, beryllium, bismuth, cadmium, calcium, manganese, selenium, titanium, tungsten, vanadium, and the like; metallic compoinds including metal oxides such as aluminum oxide, iron oxide, copper oxide, nickel oxide, zinc oxide, titanium oxide, magnesium oxide, and the like; refractory nitrides such as vanadium nitride, chromium nitride, and the like; such carbides as tungsten carbide, silica carbide, and the like; and ferrites and the mixtures thereof. The proportion of such magnetic materials to be contained in toner should be from about 50 to 300 parts by weight, preferably from 50 to 200 parts by weight per 100 parts by weight of the polymer component.

Typical titanate coupling agents that are preferably used in the present invention as an agent to make the magnetic particles lyophilic have the following formulas:

$$Ti[OR_1]_4 \quad \text{(I)}$$

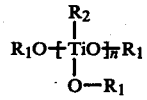

(II)

$$[R_1O]_{4-w}Ti[R_3]_w \quad \text{(III)}$$

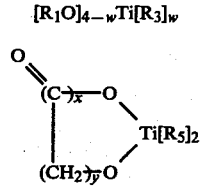

(IV)

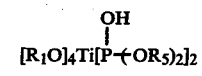

(V)

wherein $R_1$ represents an alkyl group having 1 to 18 carbon atoms or an aralkyl group; $R_2$ represtnts the same as $—OR_1$ or $R_1COO—$; $R_3$ is $R_1COO—$, $R_4SO_3—$ or

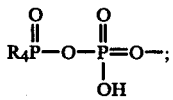

$R_4$ represents the same as $R_1$ or an aryl group; $R_5$ represents the same as $R_1$ or $R_3$; $R_6$ is the same as $R_1$ or an aryl group; n is an integer of from 2 to 20; w is 1, 2 or 3; x is 0 or 1; and y is an integer of from 1 to 3.

The groups appeared in all the general formulas include the substituted as explained before. Although the substituents may be any substituents, preferred ones are one or more appropriately selected from the group consisting of hydroxy, an alkyl group, an aryl group, an acyl group and mono- or di alkyl amino group.

Specific examples of these compounds are listed below:

$Ti(OC_3H_7—iso)_4$ (A-1)

$Ti(OC_4H_9—n)_4$ (A-2)

$Ti(OCH_2CHC_4H_9)_4$ (A-3)
$\quad\quad\quad

-continued

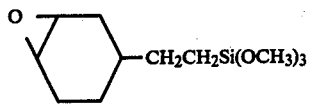

(B-4)

$CH_2=CH-CH_2O(CH_2)_3Si(OCH_3)_3$ (B-5)

$CH_2=C(CH_3)-COOCH_2CH_2CH_2Si(OCH_3)_3$ (B-6)

$H_2N(CH_2)_2NH(CH_2)_3Si(CH_3)_2$ (B-7)

$H_2N(CH_2)_3Si(OCH_3)_3$ (B-8)

These coupling agents are used in an amount of from 0.01 to 10% by weight, preferably from 0.05 to 5% by weight, of the binder resin in the toner powder.

As described above, the nuclear particles in the magnetic toner of the present invention are prepared by coating the magnetic particles with the coupling agent, melting the coated particles with a resin having low softening point, milling the molten blend, cooling the milled blend and pulverizing the cooled blend. Alternatively, magnetic particles coated with the coupling agent are blended with the monomers for forming the resin, or uncoated magnetic particles are blended with the monomers, and the blend is subjected to suspension polymerization for producing the nuclear particles.

Because of the presence of the coupling agent, the magnetic particles are not only uniformly dispersed in the resin but also firmly bonded to the resin, so a durable magnetic toner can be produced by using the nuclear particles formed by the methods described above. As a further advantage, the nuclear particles are resistant to the attack of the solvent used when a resin wall is formed around each nuclear particle. But preferably, the solvent used is such that it dissolves the wall forming resin but does not dissolve or dissolves only a little of the resinous nuclear particles. If the resinous nuclear particles are soluble in organic solvents, the resin wall may be made of a water-soluble resin, and if they are soluble in water, the resin wall may be made of a resin soluble in organic solvents. The resin wall can be formed by any of the known encapsulating techniques, such as spray-drying, interfacial polymerization, coarcervation, phase separation and in situ encapsulation, which are described in U.S. Pat. No. 3,338,991, U.S. Pat. No. 3,326,848, U.S. Pat. No. 3,502,582, etc.

The preferred resin for forming a wall around each of the nuclear particles is such that it forms a wall of a uniform thickness, it does not form an agglomerate and it does not impair the pressure-fixability of the toner. Suitable resins include homopolymers or copolymers of styrene and substituted styrenes such as polystyrene, poly-p-chlorostyrene, polyvinyltoluene, styrene-butadiene copolymer, styrene-acrylic acid copolymer and styrene-maleic anhydride copolymer; polyester resins, acrylic resins; xylene resins; polyamide resins; ionomer resins; furan resins; ketone resins; terpene resins; phenol modified terpene resins; rosins; rosin modified pentaerythritol esters; natural resin modified phenolic resins; natural resin modified maleic resins; cumaroneindene resins, maleic acid modified phenolic resins; alicyclic hydrocarbon resins; petroleum resins; cellulose phthalate acetate; methyl vinyl ether-maleic anhydride copolymers; graft polymers of starch; polyvinyl butyral; polyvinyl alcohol; polyvinyl pyrrolidone; chlorinated paraffin, wax and aliphatic acids. These compounds can be used alone or in combination. Particularly preferred are styrene resins, polyester resins, maleic acid modified phenolic resins, cellulose phthalate acetate, graft polymers of starch, casein, carboxymethyl cellulose, polyvinyl butyral and cyclized rubber. These are described in many references such as Japanese Patent Applications (OPI) Nos. 64251/80, 4549/78, 36243/78, Japanese Patent Publications Nos. 21098/79, 8104/79, 31994/79, G. L. Harpavat, IEEE-IAS Annual Meeting, 236(1978).

The binder resin in the nuclear particles and the wall forming resin, two of the essential components of the toner of the present invention, may be crosslinked with any one of the following crosslinking agents on the condition that the binder resin does not impair the pressure-fixability of the toner. Illustrative crosslinking agents include aromatic divinyl compounds such as divinylbenzene, divinylnaphthalene and derivatives thereof; diethylenically unsaturated carboxylic acid esters such as ethylene glycol dimethacrylate, diethylene glycol dimethacrylate, triethylene glycol dimethacrylate, trimethylolpropane triacrylate, acrylmethacrylate, t-butylaminoethyl methacrylate, tetraethylene glycol dimethacrylate and 1,3-butanediol dimethacrylate; all divinyl compounds such as N,N-divinylaniline, divinyl either, divinyl sulfide and divinylsulfone; and compounds having three or more vinyl groups. These compounds may be used alone or in combination. Other examples include divalent alcohols such as ethylene glycol, triethylene glycol, 1,2-propylene glycol, 1,3-propylene glycol, 1,4-butanediol, neopentyl glycol, 1,4-butenediol, 1,4-bis(hydroxymethyl)cyclohexanone, bisphenol A, hydrogenated bisphenol A, polyoxyethylene substituted bisphenol A and polyoxypropylene substituted bisphenol A; dibasic acids such as maleic acid, fumaric acid mesaconic acid, citraconic acid, itaconic acid, glutaconic acid, phthalic acid, isophthalic acid, terephthalic acid, cyclohexanedicarboxylic acid, succinic acid, adipic acid, sebacic acid, malonic acid, derivatives thereof such as anhydrides and esters with lower alcohols; trivalent or higher alcohols such as glycerin, trimethylolpropane and pentaerythritol; and trivalent or higher carboxylic acids such as trimellitic acid and pyromellitic acid. The above listed crosslinking agents are generally used in an amount of from 0.005 to 20% by weight, preferably from 0.1 to 5% by weight, of the resin.

The toner of the present invention may further include colorants such as pigments or dyes in the nuclear particles or wall forming resin. Any known colorant can be used, such as carbon black, Nigrosine dye, Aniline Blue, chalcooil blue, chrome yellow, ultramarine blue, Du Pont oil red, quinoline yellow, methylene blue chloride, Phthalocyanine Blue, Malachite Green oxalate, lamp black, oil black, azooil black, Rose Bengale and mixtures thereof. Where xerographic copying of printed documents is desired, the toner may contain a black dye such as carbon black or Amaplast black dye. The colorant is used in the magnetic toner of the present invention in an amount of from 1 to 20 parts by weight of the toner.

To prevent the occurrence of off-setting during the fixing step with a roller the toner, particularly, the resin wall may contain a releasing agent. Various release agents are known, and a low-molecular polyolefine is the most preferred. The low-molecular polyolefine include polyolefine that contain only olefins as the monomer component and which have a low-molecular weight, as well as olefin copolymers that contain not only olefins but also other comonomers and which have a low molecular weight. All olefins can be used as the monomer component, such as ethylene, propylene, butene-1, pentene-1, hexene-1, heptene-1, octene-1, nonene-1, decene-1 and isomers thereof having an unsaturated bond at different positions, as well as 3-methyl-1-butene, 3-methyl-2-pentene, 3-propyl-5-methyl-2-hexene and their derivatives having an alkyl group as a branched chain. Illustrative comonomers that form olefin copolymers with olefins include vinyl ethers such as vinylmethyl ether, vinyl-n-butyl ether and vinylphenyl ether; vinyl esters such as vinyl acetate and vinyl butyrate; haloolefins such as vinyl fluoride, vinylidene fluoride, tetrafluoroethylene, vinyl chloride, vinylidene chloride and tetrachloroethylene; acrylic esters such as methyl acrylate, ethyl acrylate, and n-butyl acrylate, as well as methacrylic esters such as methyl methacrylate, ethyl methacrylate, n-butyl methacrylate, stearyl methacrylate, N,N-dimethylaminoethyl methacrylate and t-butylaminoethyl methacrylate; acrylic derivatives such as acrylonitrile and N,N-dimethylacrylamide; organic acids such as acrylic acid, methacrylic acid, maleic acid, fumaric acid and itaconic acid, and diethyl fumarate and $\beta$-pinene.

The low-molecular olefinic polymers used in the present invention include olefin polymers that consist of only two or more of the olefin monomers listed above, such as ethylene-propylene copolymer, ethylene-butene copolymer, ethylene-pentene copolymer, propylene-butene copolymer, propylene-pentene copolymer, ethylene-3-methyl-1-butene copolymer and ethylene-propylene-butene copolymer, and olefin copolymers that consist of at least one of the olefin monomers listed above and at least one of the comonomers other than olefin that are listed above, such as ethylene-vinyl acetate copolymer, ethylene-vinyl methyl ether copolymer, ethylene-vinyl chloride copolymer, ethylene-methyl acrylate copolymer, ethylene-methyl methacrylate copolymer, ethylene-acrylic acid copolymer, propylene-vinyl acetate copolymer, propylene-vinylethyl ether copolymer, propylene-ethyl acrylate copolymer, propylene-methacryl acid copolymer, butene-vinylmethyl methacrylate copolymer, pentenevinyl acetate copolymer, hexene-vinyl butyrate copolymer, ethylene-propylene-vinyl acetate copolymer, and ethylene-vinyl acetate-vinyl-methyl ether copolymer. The low-molecular polyolefine has a softening point of from 80° to 180° C., preferably from 100° to 160° C.

The toner image formed by deposition of the magnetic toner particles having resin walls of the present invention is passed between a pair of pressure-loaded rollers for fixing, with optional heating. Conventional pressure fixing systems can be used in the present invention such as those described in Japanese Patent Publication No. 12797/69, U.S. Pat. No. 3,269,626, U.S. Pat. No. 3,612,682, U.S. Pat. No. 3,655,282 and U.S. Pat. No. 3,731,358, and they can be used with the magnetic toner having resin walls of the present invention.

Evaluation of fixability of the toner may be performed in accordance with the method of testing color fastness to friction specified in JIS-10849-1971, wherein the surface of the photoreceptor on which the toner particles are fixed is rubbed against a white cotton cloth in a friction tester according to the specified procedures of dry test, and the stain on the cotton cloth is compared with the standard gray scale on a ten grade basis. Grades 1 and 2 indicate that the fixation of the toner particles is firm enough to suit practical purposes, and the desired fixation is achieved by grade 3 or higher, preferablt grade 4 or higher.

The pressure-fixable capsule toner of the present invention having the construction described above is capable of withstanding an impact of at least 10 kg/cm in terms of linear pressure, has a long service life, has high fluidity when it is made of spherical particles, and does not stick to the surface of the carrier, developing sleeve or photoreceptor. An upper limit of the linear pressure is 70 kg/cm. As further advantages, it performs particularly well when used in pressure fixing without off-setting to the pressure rollers.

A multi-copy experiment was made with the magnetic toner of the present invention using a commercial copier modified to permit pressure fixing; the developing properties and fixability of the toner remained the same over many cycles of copying, and at the same time, it could be stored for an extended time period without agglomeration or caking of the toner particles.

The present invention is now described in greater detail by reference to the following examples which are given here for illustrative purposes only and are by no means intended to limit its scope.

EXAMPLE 1

The parts by weight of magnetic particles with a black pigment (Mapicoblack BL-500 of Titan Kogyo Kabushiki Kaisha) and 0.5 part by weight of a silane coupling agent KBM 503 ($\gamma$-methacryloxypropyl trimethoxysilane) were dispersed in toluene under stirring, and the dispersion was dried at 100° C. for 2 hours. Sixty five parts of the so treated magentic particles, 35 parts of a copolymer made of styrene (30 parts) and butyl methacrylate (70 parts) and 1.5 parts of Nigrosine were mixed in a ball mill for 12 hours, and the resulting dispersion was melted and milled between two heated rolls. The milled dispersion was cooled, crushed coarsely and pulverized with a jet mill. The pulverized particles were injected momentarily into a hot blast air in a commercial spray dryer (Mobil Miner of Nilo Corporation) at about 250° C. to produce spherical nuclear particles. The particles were classified with a zigzag classifier to obtain nuclear particles with an average size of 15$\mu$. The particles had a softening point of 70° C. They were immersed in a 10% solution of styrene resin in cyclohexane, recovered from the solution and dried with a hot blast of air to form a resin wall around each particle. The resin wall had a softening point of 120° C. The so prepared toner was referred to as Sample No.1.

EXAMPLE 2

Ten parts by weight of steamed tri-iron tetroxide particles with an average size of about 0.5$\mu$ and 0.5 part by weight of a silane coupling agent KBM 503 ($\gamma$-methacryloxypropyl trimethoxysilane) were dispersed in 50 parts by weight of toluene under stirring, and the dispersion was dried at 100° C. for 2 hours. Eighty parts of the so treated magnetic particles, 25 parts of styrene, 20 parts of n-butyl methacrylate, 3 parts of azobisisobutyronitrile, 25 parts of paraffin wax (m.p. 60° C.) and 4 parts of carbon black (seegal 600) were mixed in a ball mill, and the mixture was added under stirring to 200 parts of water having 3 parts of polyvinyl alcohol dissolved therein. The solution was transferred to a TKhomomixer (product of Tokushu Kita Kogyo Co., Ltd.) where it was agitated at 3500 r.p.m. until the average particle size was 12μ. The resulting dispersion was transferred to a polymerization vessel where it was subjected to polymerization for 8 hours at 70° C. under stirring at 300 r.p.m. The polymer was cooled, washed thoroughly with water, and dehydrated to produce apparently spherical nuclear particles having an average size of about 12μ.

The nuclear particles were dispersed thoroughly in a 10% solution of styrene-butadiene copolymer in cyclohexane, and the dispersion was dried with a spray dryer to produce a capsule toner wherein each nuclear particle was surrounded by the wall of the styrene-butadiene copolymer. The so produced toner was referred to as Sample No.2.

A comparative capsule toner was prepared as in the production of Sample No. 1 except that the tri-iron tetroxide particles were not treated with a silane coupling agent. The comparative toner was referred to as Sample No.3. Another comparative capsule toner was prepared as in the production of Sample No.1 except that no resin wall was formed around the individual nuclear particles. The so prepared toner was referred to as Sample No.4.

Latent images were developed with the toner samples using a U-Bix T (electrophotographic copier of Konishiroku Photo Industry Co., Ltd.) modified to incorporate a pressure fixing system with stainless steel rollers having a linear pressure of 20 kg/cm. The pictorial rendition of the developed images was evaluated with respect to fog, copy density and dye fastness of the fixed toner image. The results are listed in Table below, which also includes data on the stability of the toner during storage.

TABLE 1

| Factor | Sample No. 1 | 2 | 3 | 4 |
|---|---|---|---|---|
| Fog | ◎ | ◎ | ○ | ○ |
| Copy density | ◎ | ◎ | x | ○ |
| Dye fastness of fixed toner image | ◎ | ○ | x | ○ |
| Keeping quality | ◎ | ◎ | ○ | x |

Fog and copy density were measured both visuality and with a Sakura densitometer (product of Konishiroku Photo Industry Co., Ltd.): a fog of less than 0.02 was rated ◎ (good), from 0.02 to less than 0.05, ○ (fairly good), and 0.05 or higher, x (poor), and a copy density of less than 0.6 was rated x (poor), from 0.6 to less than 0.8, ○ (fairly good), and 0.8 or higher, ◎ (good). The dye fastness of the fixed toner image was evaluated by rubbing several times the surface of a copy paper with the toner against itself: an intact toner image was rated ◎ (good), a partially lost toner image, ○ (fairly good), and an image lost by half, x (poor). Keeping quality of the toner was checked by making a copy with a toner that had been left for one week at 30° C. and r.h. 80%: the toner was rated ◎ (good) if it produced an image as good as that obtained with the original toner, ○ (fairly good) if a faint image was obtained, and x (poor) if no image was developed.

Table 1 shows that the toners of the present invention (Samples Nos. 1 and 2) were far better than the comparative toners (Samples Nos. 3 and 4) with respect to image quality, dye fastness of the fixed toner image and keeping quality of the toner.

EXAMPLE 3

Sixty parts of styrene, 70 parts of dodecyl methacrylate, 3 parts of divinylbenzene, 2 parts of a titanate coupling agent TBSTA-400 (Nippon Soda Co., Ltd.), 150 parts of a black dye (Mapico-black BL-500, tri-iron tetroxide particles manufactured by Titan Kogyo Kabushiki Kaisha), and 5 parts of carbon black (Mitsubishi Carbon Black Ma-600 of Mitsubishi Gas Chemical Company, Inc.) were mixed at room temperature for 2 hours under stirring. In the mixture, 3 parts of a polymerization initiator V-65 [2,2'-azobis(2,4-dimethylvaleronitrile) of Wako Pure Chemical Industries, Ltd.] was dispersed.

The resulting dispersion was added to 600 parts of a 1.25 wt% aqueous solution of polyvinyl alcohol in a 2-liter separable flask, and the mixture was put in a TK homomixer (product of Tokushu Kika Kogyo Co., Ltd.) where it was agitated at 3,500 r.p.m. for 30 minutes until the average size of the dispersed particles was between 10 and 15 microns. Thereafter, the dispersion was transferred to a polymerization vessel for 7 hours at an elevated temperature of 60° C. under stirring at 600 r.p.m. with a conventional stirrer. The polymer was dried to obtain magnetic nuclear particles having an average size of 13 microns.

The nuclear particles were dispersed in a solution comprising 50 parts of cyclized rubber (Alpex CK 450 of Hoechst Aktiengesellschaft, with an iodine value of 165 and an average mol. wt. of 10,000) and 500 parts of xylene. The dispersion was dried with a two-fluid nozzle type spray drier of Mitsubishi Kakoki Kaisha, Ltd. (entrance temp.: 150° C., exit temp.: 100° C., flow rate: $9m^3$/min) to produce a capsule toner having an average particle size of 15 to 20 microns. The toner was referred to as Sample No.5.

A comparative toner was prepared as in the production of Sample No.5 except that the tri-iron tetroxide particles were not treated with a titanium coupling agent. The comparative toner was referred to as Sample No.6. Another comparative toner was prepared as in the production of Sample No.5 except that no resin wall was formed around the individual nuclear particles. The so prepared comparative toner was referred to as Sample No.7.

The three samples were subjected to the same tests as in Example 1: only Sample No.5 of the present invention had good image quality and keeping quality, and Samples Nos. 6 and 7 the comparative toners, were inferior to Sample No.5 in both image quality and keeping quality.

What is claimed is:

1. A magnetic toner comprising a nuclear particle which comprises lyophilic magnetic particles and a resin having a low softening point, said particles being encapsulated within a resin wall, wherein said magnetic particles are made lyophilic by treatment with a titanate coupling agent and/or a silane coupling agent.

2. A magnetic toner according to claim 1, wherein said resin having a low softening point comprises a polymer which contain as a structural unit an α,β-unsatulated ethylenic monomer.

3. A magnetic toner according to claim 2, wherein said α,β-unsaturated ethylenic monomer is selected from the group consisting of a styrenes and an esters of α-methylene aliphatic monocarboxylic acid.

4. A magnetic toner according to claim 2, wherein said polymer is a copolymer of a styrenes and an esters of α-methylene aliphatic monocarboxylic acid.

5. A magnetic toner according to claim 3 or 4, wherein said styrenes is a styrene.

6. A magnetic toner according to claim 3 or 4, wherein said esters of α-methylene aliphatic monocarboxylic acid is an acrylate or a methacrylate.

7. A magnetic toner according to claim 2, wherein said resin has softening point not exceeding 100° C.

8. A magnetic toner according to claim 1, wherein said magnetic particles is a magnetite.

9. A magnetic toner according to claim 1, wherein said resin wall comprises a polystyrenes, a styrene-butadiene copolymer, a styrene-acrylic acid copolymer, a styrene-maleic anhydride copolymer, a polyester resins, an acrylic resins, a xylene resins, a polyamide resins, an ionomer resins, a furan resins, a ketone resins, a terpene resins, a phenol modified terpene resins, a rosins, a rosin modified pentaerythritol esters, a natural resin modified phenolic resins, a natural resin modified maleic resins, a cumaroneindene resins, a maleic acid modified phenolic resins, an alicyclic hydrocarbon resins, a petroleum resins, a cellulose phthalate acetate, a methyl vinyl ether-maleic anhydride copolymers, a graft polymers of starch, a polyvinyl butyral, a polyvinyl alcohol, a polyvinyl pyrrolidone, a chlorinated paraffin, a wax or a aliphatic acids.

10. A magnetic toner according to claim 1, wherein said resin wall further comprises a releasing agent.

11. A magnetic toner according to claim 10, wherein said releasing agent is a low-molecular polyolefine.

12. A magnetic toner according to claim 11, wherein said low-molecular polyolefine has a softening point of 80°-180° C.

13. A magnetic toner according to claim 12, wherein said low-molecular polyolefine has a softening point of 100°-160° C.

14. A magnetic toner according to claim 1, wherein said toner further comprises a coloring agent.

15. A magnetic toner according to claim 14, wherein said coloring agent is included in the nuclear particles.

16. A magnetic toner according to claim 14, wherein said coloring agent is included in the resin wall.

17. The toner of claim 1 wherein said coupling agent is a titanate coupling agent.

18. A method of fixing a toner image on a sheet bearing said toner image by passing said sheet between a fixing roller and a pressure roller being pressure contacted with said fixing roller, the toner image consiting essentially of the magnetic toner of claim 1.

19. A method of fixing according to claim 18, wherein said linear pressure between rollers is at least 10 kg/cm.

20. A magnetic toner comprising a nuclear particle which comprises lyophilic magentic particles and a resin having a low softening point, said particle being encapsulated within a resin wall, wherein said magnetic particles are made lyophilic by treatment with a titanate coupling agent selected from the class consisting of formulas I, II, III, IV and V $$Ti[OR_1]_4 \quad \text{(I)}$$

$$R_1O\text{-}\left[\begin{array}{c}R_2\\ | \\ Ti\\ | \\ O\text{-}R_1\end{array}\right]_n\text{-}R_1 \quad \text{(II)}$$

$$[R_1O]_{4-w}Ti[R_3]_w \quad \text{(III)}$$

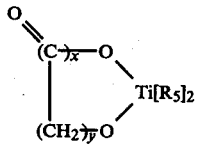

(IV)

$$[R_1O]_4Ti[P\text{-}(OR_5)_2]_2 \quad \text{(V)}$$

wherein $R_1$ represents an alkyl group having 1 to 18 carbon atoms or an aralkyl group; $R_2$ represents $—OR_1$ or $—OOCR_1$, $R_3$ represents $—OOCR_1$, $—O_3SR_4$ or $$R_4P(=O)(OH)-O-P(=O)-O-,$$

$R_4$ represents $R_1$ or an aryl group, $R_5$ represents $R_1$ or $R_3$, $R_6$ represents $R_1$ or an aryl group; n represents an integer of from 2 to 20, w represents 1, 2 or 3, x represents 0 or 1, and y represents an integer of from 1 to 3.

21. A magnetic toner comprising a nuclear particle which comprises lyophilic magnetic particles and the resin having a low softening point, wherein said nuclear particles are encapsulated by a resin wall and said magnetic particles are made lyophilic by treatment with a silane coupling agent selected from the group consisting of Formulas B-1 to B-8

$$CH_2{=}CH{-}Si(Cl)_3 \quad \text{(B-1)}$$

$$CH_2{=}CH{-}Si(OC_2H_5)_3 \quad \text{(B-2)}$$

$$CH_2{=}CH{-}Si(OCH_2CH_2OCH_3)_3 \quad \text{(B-3)}$$

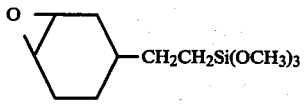

(B-4)

$$CH_2\text{-}CH{-}CH_2O(CH_2)_3Si(OCH_3)_3 \quad \text{(B-5)}$$

$$CH_2{=}C(CH_3){-}COOCH_2CH_2CH_2Si(OCH_2)_3 \quad \text{(B-6)}$$

$$H_2N(CH_2)_2NH(CH_2)_3Si(CH_3)_2 \quad \text{(B-7)}$$

$$H_2N(CH_2)_3Si(OCH_3)_3. \quad \text{(B-8)}$$

* * * * *